US008644529B2

(12) United States Patent
Ejaz et al.

(10) Patent No.: US 8,644,529 B2
(45) Date of Patent: Feb. 4, 2014

(54) FULLY DIFFERENTIAL LOW-NOISE CAPACITOR MICROPHONE CIRCUIT

(75) Inventors: Muhammad Ejaz, Twinsburg, OH (US); Kelly Statham, Cleveland, OH (US)

(73) Assignee: CAD Audio, LLC, Solon, OH (US)

( * ) Notice: Subject to any disclaimer, the term of this patent is extended or adjusted under 35 U.S.C. 154(b) by 415 days.

(21) Appl. No.: 12/903,553

(22) Filed: Oct. 13, 2010

(65) Prior Publication Data

US 2011/0085683 A1 Apr. 14, 2011

Related U.S. Application Data

(60) Provisional application No. 61/250,905, filed on Oct. 13, 2009.

(51) Int. Cl.
*H04R 1/04* (2006.01)

(52) U.S. Cl.
USPC ..... 381/174; 381/111; 381/122; 381/355; 381/150

(58) Field of Classification Search
USPC ..... 381/174, 369, 111, 113, 92, 94.9, 95
See application file for complete search history.

(56) References Cited

U.S. PATENT DOCUMENTS

| | | | | |
|---|---|---|---|---|
| 4,491,697 | A * | 1/1985 | Tanaka et al. | 381/113 |
| 4,820,971 | A | 4/1989 | Ko et al. | |
| 4,888,807 | A | 12/1989 | Reichel | |
| 6,104,818 | A | 8/2000 | Körner | |
| 7,271,673 | B2 | 9/2007 | Song | |
| 7,443,204 | B2 | 10/2008 | Phang et al. | |
| 7,595,618 | B2 | 9/2009 | Kranz | |
| 7,605,753 | B2 | 10/2009 | Landmark | |
| 7,629,856 | B2 | 12/2009 | Thaller | |
| 7,642,861 | B2 | 1/2010 | Lewis | |
| 7,657,232 | B2 | 2/2010 | Palaskas et al. | |
| 7,671,773 | B2 | 3/2010 | Ceballos | |
| 7,728,528 | B2 | 6/2010 | Chan et al. | |
| 2003/0194100 | A1 | 10/2003 | Boor | |
| 2006/0078152 | A1 * | 4/2006 | Royer et al. | 381/399 |
| 2009/0141909 | A1 | 6/2009 | van Katz et al. | |
| 2009/0214057 | A1 | 8/2009 | Lou | |

FOREIGN PATENT DOCUMENTS

JP 2520929 A * 5/1996 ..... H04R 3/00

OTHER PUBLICATIONS

F.W.O. Bauch, New High-Grade Condenser Microphones, Journal of the Audio Engineering Society, Jul. 1953, pp. 232-240, vol. 1, No. 3.
Gerhart Boré, Stephan Peus, Microphones 'Methods of Operation and Type Examples,' Fourth Edition 1999, Druck-Centrum Fürst GmbH, Berlin, Germany, website: www.neumann.com.

* cited by examiner

*Primary Examiner* — Brian Ensey
*Assistant Examiner* — Sabrina Diaz
(74) *Attorney, Agent, or Firm* — Emerson Thomson Bennett, LLC; Roger D. Emerson; Sergey Vernyuk

(57) ABSTRACT

A microphone circuit includes a capacitor capsule and first and second impedance converters connected differentially to the capacitor capsule. The microphone circuit includes first and second output buffer amplifiers connected differentially to the first and second impedance converters.

18 Claims, 6 Drawing Sheets

FULLY DIFFERENTIAL LOW-NOISE CAPACITOR MICROPHONE CIRCUIT

CROSS-REFERENCE TO RELATED APPLICATIONS

This application claims the benefit of U.S. Provisional Application No. 61/250,905, titled FULLY DIFFERENTIAL LOW-NOISE CAPACITOR MICROPHONE CIRCUIT, filed Oct. 13, 2009, which is herein incorporated by reference.

I. BACKGROUND

A. Field of Invention

The present invention relates generally to microphones and more specifically to microphone electronics and circuits.

B. Description of the Related Art

Typical capacitor microphones include a microphone circuit 10 having a capacitor microphone capsule 12, an impedance converter 14, a phase splitter 16, and two output buffer amplifiers 18, 20, as shown in FIG. 1 of the prior art. Two output buffer amplifiers 18, 20 are generally needed because the output 22 of professional microphones is usually differential and impedance balanced. These output signals are subtracted in the microphone preamplifier or mixing console to minimize the effects of cable capacitance as well as to cancel the common-mode noise signals that may be electromagnetically induced into the microphone cable, which connects the microphone to the preamplifier or mixing console. This technique is often used and well known in the art. The microphone capsule 12 is either biased externally, or in the case of an electret capacitor capsule, biased internally by a static electrical charge. Capacitor microphone capsules are well known in the art.

FIG. 2 of the prior art shows a simplified embodiment of the capacitor microphone circuit 10. The impedance converter 14 is usually comprised of a low-noise field-effect transistor (FET) with the gate bias fed via a very large value resistor Rb, usually about 1G ohm. This large value resistor is necessary to preserve as much of the high-impedance signal from the microphone capsule 12 as possible to maximize signal-to-noise ratio. The phase splitter 16 is often another field-effect transistor arranged in a cathodyne configuration, with equal resistors at the drain and the source. The output buffer amplifiers 18, 20 are often PNP type transistors arranged as emitter followers. Power 24 is usually supplied to the microphone circuit 10 by the mixing console or outboard preamp in a simplex fashion, via the same conductors as the differential output signal. This power arrangement is known in the art as "phantom power." The microphone circuit 10 includes the voltage source VDD and bias circuits 30.

FIG. 3 of the prior art shows the following modifications which can be made to the microphone circuit 10 to improve signal-to-noise ratio. The output of the FET impedance converter 14 can be fed back to the input of the impedance converter 14 via a bootstrap capacitor 26. This slightly less-than-unity positive feedback helps raise the input impedance of the circuit 10 by cancelling out the loading effect of the FET gate capacitance. Gate capacitance creates a voltage divider with the capsule capacitance and acts as a signal attenuator, which negatively affects signal-to-noise performance. The source resistor of the FET impedance converter can be replaced with a current source 28. This current source 28 has a high AC compliance, which reduces the loading of the FET output signal caused by the FET source resistor Rs. Because the source resistor of the current source 28 can be lower than Rs, the resistor thermal noise contribution can also be reduced. The microphone circuit 10 includes the voltage source VDD and bias circuits 30.

There still remains at least two major sources of noise that limit the signal-to-noise ratio of the circuit 10 in FIG. 3 of the prior art, even if the lowest possible noise FETS are used. The first major source is the thermal noise of the source and drain resistors used in the cathodyne circuit 16. This noise can be reduced by decreasing the value of these resistors; however, reducing these resistors causes an increase in power consumption, which increases as the square of the cathodyne current. The second major source is power supply noise. Any noise present on the voltage source VDD will be algebraically added to the desired signal, thus limiting further signal-noise ratio improvements.

Therefore, what is needed is a method and apparatus for reducing the thermal noise, without appreciably increasing the power consumption, and the power supply noise in microphone electronic circuits.

II. SUMMARY

According to one embodiment of this invention, a microphone circuit includes a capacitor capsule and first and second impedance converters connected differentially to the capacitor capsule. The microphone circuit can include first and second output buffer amplifiers connected differentially to the impedance converters. The microphone circuit can include a first output buffer amplifier connected to the first impedance converter and a second output buffer amplifier connected to the second impedance converter. The first impedance converter can include a first field effect transistor having a gate connected to a first terminal of the capacitor capsule, and the second impedance converter can include a second field effect transistor having a gate connected to a second terminal of the capacitor capsule. The first output buffer amplifier can include a first bipolar transistor having a base connected to a source of the first field effect transistor, and the second output buffer amplifier can include a second bipolar transistor including a base connected to a source of the second field effect transistor. The first impedance converter can include a first bootstrap capacitor that feeds the output of the first impedance converter back into the input of the first impedance converter, and the second impedance converter can include a second bootstrap capacitor that feeds the output of the second impedance converter back into the input of the second impedance converter. The first and second output buffer amplifiers can each form an emitter follower circuit. The first impedance converter can include a first current source, and the second impedance converter can include a second current source. The first current source can include a field effect transistor having a gate connected to the signal ground, a source connected to the signal ground through a resistor, and a drain connected to the first impedance converter. The second current source can include a field effect transistor having a gate connected to the signal ground, a source connected to the signal ground through a resistor, and a drain connected to the second impedance converter.

According to another embodiment, a microphone circuit includes: a capacitor capsule including a first terminal and as second terminal; first and second impedance converters connected differentially to the capacitor capsule, wherein the first impedance converter comprises a first field effect transistor including a gate connected to the first terminal of the capacitor capsule, wherein the second impedance converter comprises a second field effect transistor including a gate connected to the second terminal of the capacitor capsule, wherein the first impedance converter further comprises a first bootstrap capacitor and a first current source, and wherein the second impedance converter further comprises a second bootstrap capacitor and a second current source; first and second output buffer amplifiers connected differentially to the impedance converters, wherein the first and second output buffer amplifiers form emitter follower circuits, wherein the first output buffer amplifier comprises a first bipolar transistor including a base connected to a source of the first field effect transistor, and wherein the second output buffer amplifier comprises a second bipolar transistor including a base connected to a source of the second field effect transistor.

According to another embodiment, a method includes the steps of connecting first and second impedance converters to a capacitor capsule differentially by connecting the first impedance converter to a first terminal of the capacitor and by connecting the second impedance converter to a second terminal of the capacitor. The method can include the steps of connecting a first output buffer amplifier to the first impedance converter and connecting a second output buffer amplifier to the second impedance converter. The method can include the steps of connecting a first current source to the first impedance converter and connecting a second current source the second impedance converter.

One advantage of this invention is that thermal noise is substantially reduced without an appreciable increase in power consumption. Another advantage of this invention is that power supply noise is substantially reduced.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

Figure 4:
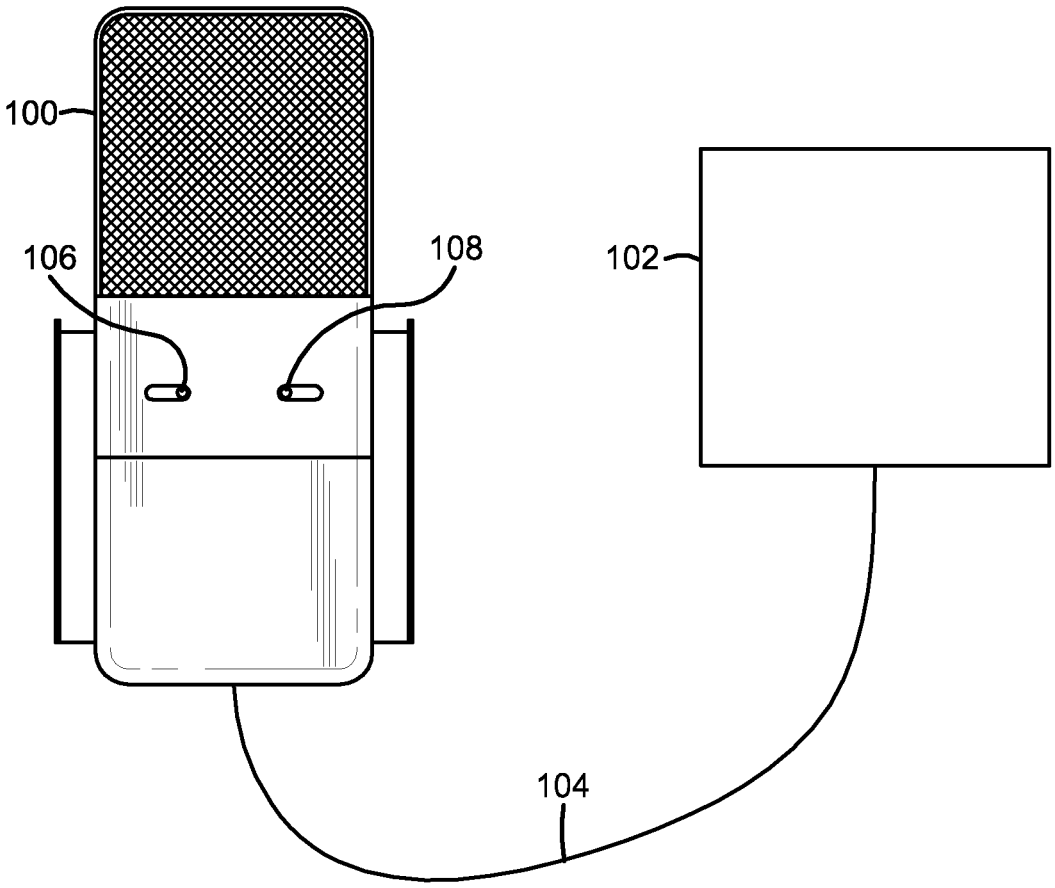
FIG. 4 is a perspective view of a microphone system, according to one embodiment of the present invention.

Referring now to the drawings wherein the showings are for purposes of illustrating embodiments of the invention only and not for purposes of limiting the same, and wherein like reference numerals are understood to refer to like components, FIG. 4 shows a condenser or capacitor microphone 100 including a microphone capsule or capacitor capsule, as is known in the art. Microphone capsules are also discussed in U.S. Non-Provisional patent application Ser. No. 12/783,396, titled VARIABLE PATTERN HANGING MICROPHONE SYSTEM WITH REMOTE POLAR CONTROL, filed May 19, 2010, which is herein incorporated by reference in its entirety. The microphone 100 can be connected to a microphone preamplifier or mixing console 102 with a microphone cable 104. The microphone 100 can include an attenuation switch 106, a hi-pass switch 108, and a microphone circuit 110. In some embodiments, the attenuation switch 106 activates a 10 dB pad and the hi-pass switch 108 activates an 80 Hz hi-pass filter. According to a specific embodiment, the microphone 100 includes: a permanently-biased condenser or capacitor capsule; a supercardioid polar pattern; a frequency response of approximately 40 Hz-18 KHz; a sensitivity of approximately −30 dB (28 mV) @ 1 Pa, an impedance of approximately 140 ohms, a maximum SPL (sound pressure level) of approximately 150 dB with the pad engaged, self noise of approximately 3.7 dBA, a selectively engaged hi-pass filter at approximately 80 Hz with approximately 6 dB/oct, a selectively engaged attenuator at approximately 10 dB, and a phantom power requirement of approximately 48V at 2 mA (P48 standard phantom power).

Figure 1:
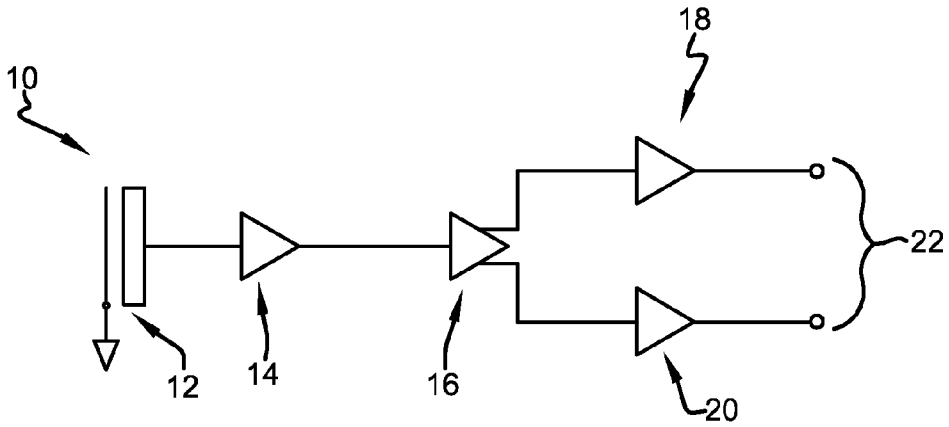
FIG. 1 PRIOR ART
FIG. 1 is a schematic diagram of a microphone circuit, according to the prior art.
Figure 2:
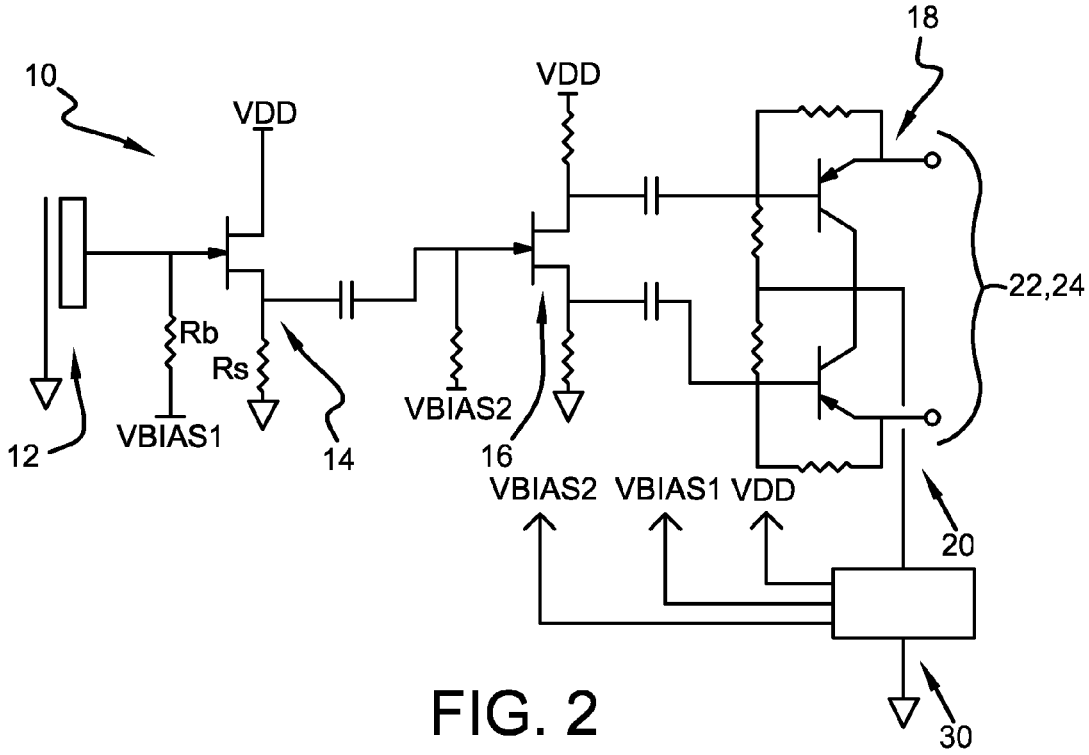
FIG. 2 PRIOR ART
FIG. 2 is a schematic diagram of a microphone circuit, according to the prior art.
Figure 3:
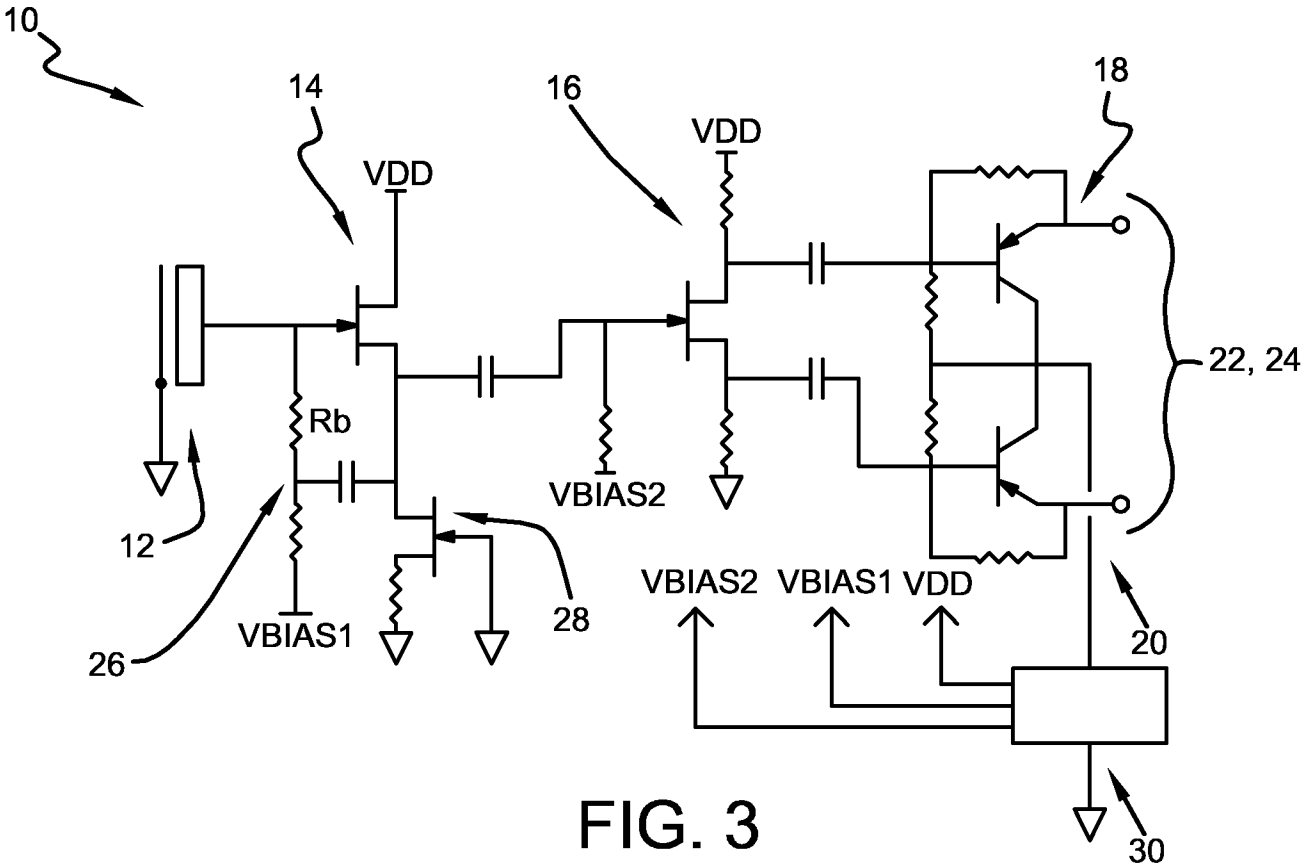
FIG. 3 PRIOR ART
FIG. 3 is a schematic diagram of a microphone circuit, according to the prior art.
Figure 5:
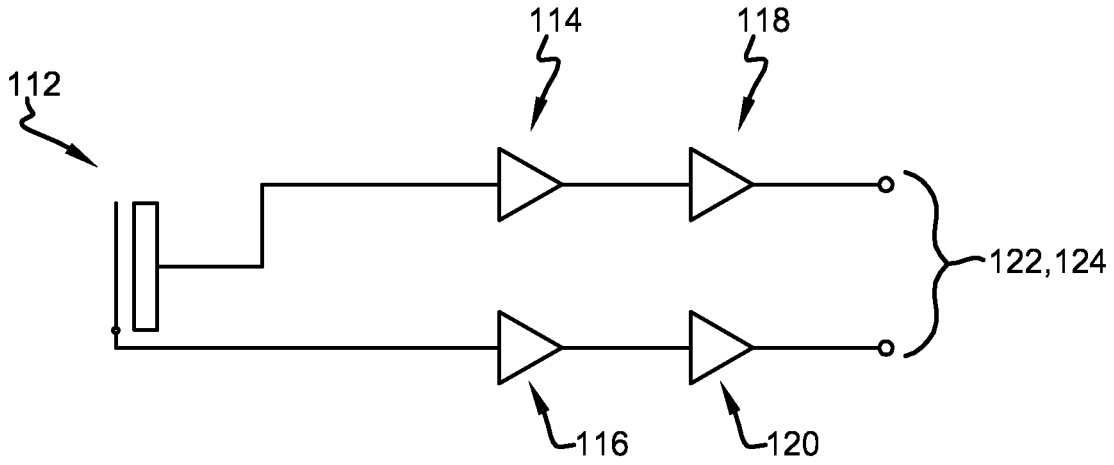
FIG. 5 is a schematic diagram of a microphone circuit, according to one embodiment of the present invention.

With reference now to FIG. 5, the microphone circuit 110 can include a microphone capacitor capsule 112, two impedance converters 114, 116, two buffer amplifiers 118, 120, and a differential balanced output 122. In this embodiment, the cathodyne phase-splitting circuit 16, shown in the prior art FIGS. 2 and 3, has been removed, and the second impedance converter 116 has been added. Thus, the noise contribution of the cathodyne resistors is removed. The circuit 110 is inherently differential beginning at the capsule 112 all the way through to the microphone output 122. In addition, any noise added by the power supply VDD is equal in both impedance converters 114, 116 and output buffers 118, 120. The subtractive differential amplifier in the microphone preamplifier or mixing console 102, shown in FIG. 4, can then cancel this noise signal.

Figure 6:
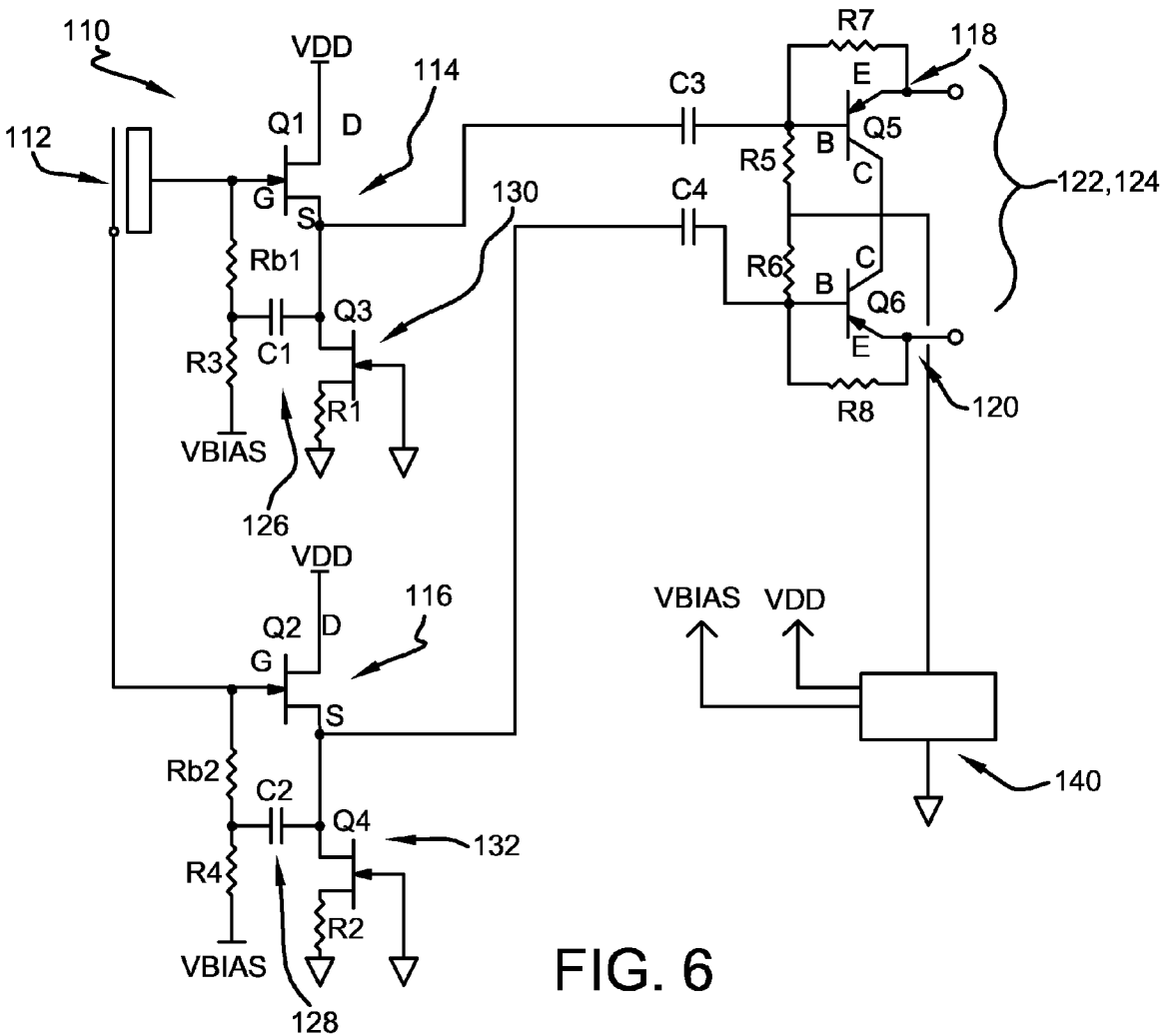
FIG. 6 is a schematic diagram of a microphone circuit, according to one embodiment of the present invention.

With reference now to FIG. 6, the microphone circuit 110 can include a microphone capacitor capsule 112, two impedance converters 114, 116, two buffer amplifiers 118, 120, a differential balanced output 122, a power input 124, two bootstrap capacitors 126, 128, two current sources 130, 132, a voltage source VDD, a voltage source Vbias, and the voltage source VDD and bias circuits 140. According to this embodiment, the capacitor capsule 112 is connected differentially to the two impedance converters 114, 116, with one terminal of the capacitor capsule 112 connected to the first impedance converter 114 and the second terminal of the capacitor capsule 112 connected to the second impedance converter 116.

According to this embodiment, the impedance converter 114 can include a transistor Q1, a capacitor C1 (126), and resistors Rb1 and R3, and the impedance converter 116 can include a transistor Q2, a capacitor C2 (128), and resistors Rb2 and R4. The current source 130 can include transistor Q3 and resistor R1, and the current source 132 can include transistor Q4 and resistor R2. The transistors Q1, Q2, Q3, and Q4 can be field effect transistors (FET), or junction gate field-effect transistors (JFET). The buffer amplifier 118 can include a transistor Q5 and resistors R5 and R7, and the buffer amplifier 120 can include a transistor Q6 and resistors R6 and R8. The transistors Q5 and Q6 can be bipolar junction transistors, commonly known as bipolar transistors. In one embodiment, the transistors Q5 and Q6 are PNP type bipolar transistors. The buffer amplifiers 118, 120 can be emitter followers. According to the embodiment shown, capacitors C3 and C4 are used to AC couple the impedance converters 114, 116 to the output buffers 118, 120, and the capacitors C3 and C4 can be configured as high-pass filters.

The bootstrap capacitor 126 can feed the output of the impedance converter 114 back into the input of the impedance converter 114, and the bootstrap capacitor 128 can feed the output of the impedance converter 116 back into the input of the impedance converter 116. This slightly less-than-unity positive feedback helps raise the input impedance of the circuit 110 by cancelling out the loading effect of the FET gate capacitance of transistors Q1 and Q2. The two impedance converters 114, 116 are current sourced via current sources 130, 132.

The capacitor microphone capsule 112 drives the two FET impedance converters 114, 116. The impedance converters 114, 116 drive the two output buffers 118, 120. The two impedance converters 114, 116 are driven by the common voltage source VDD. The output of the first impedance converter 114 feeds into the first output buffer 118, and the output of the second impedance converter 116 feeds into the second output buffer 120.

Figure 7:
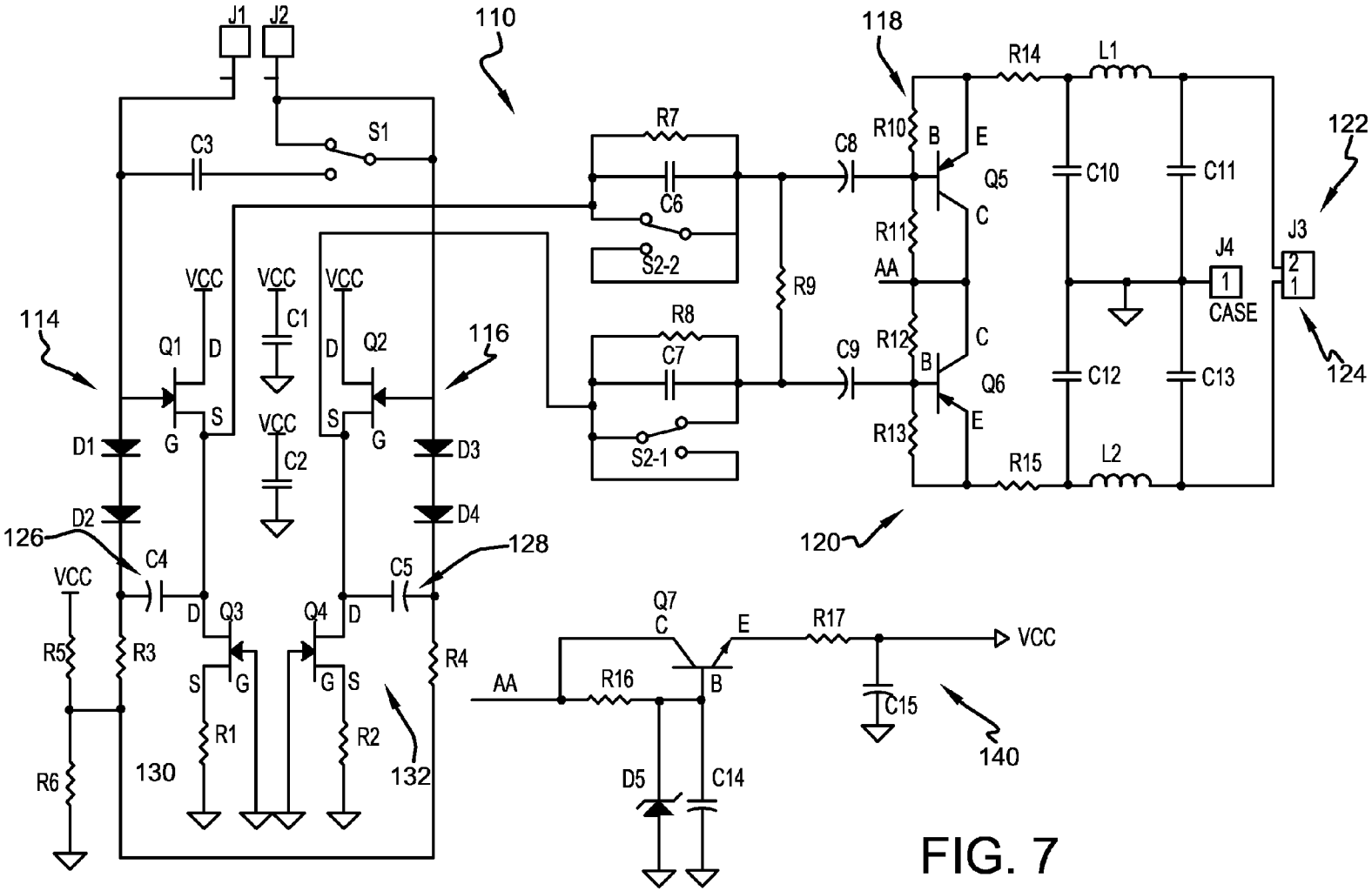
FIG. 7 is a schematic diagram of a microphone circuit, according to one embodiment of the present invention.

With reference now to FIG. 7, the microphone circuit 110 shown and described depicts a specific embodiment of the present invention. The microphone circuit 110 shown in FIG. 7 is a fully differential, low-noise, capacitor microphone circuit. According to this embodiment, the microphone circuit 110 includes two impedance converters 114, 116, two output buffer amplifiers 118, 120, a differential balanced output 122, a power input 124, a voltage source VCC, and two current sources 130, 132. In some embodiments, the voltage source VCC is between 10 and 30 volts. In other embodiments, the voltage source VCC is between 15 and 25 volts. In other embodiments, the voltage source VCC is between 17 and 23 volts. In other embodiments, the voltage source VCC is between 18 and 22 volts. In still other embodiments, the voltage source VCC is between 19 and 21 volts. In one specific embodiment, the voltage source VCC is approximately 20 volts.

According to the embodiment shown in FIG. 7, a microphone capsule (not shown) is connected differentially to J1 and J2, with one terminal of the microphone capsule connected to J1 and the second terminal of the microphone capsule connected to J2. Switch S1 and capacitor C3 create a switchable attenuator feature used to reduce the signal level in the presence of extremely loud acoustical sources. Generally, the switchable attenuator is not used. In some embodiments, capacitor C3 is a 100p capacitor. The two impedance converters 114, 116 can include transistors Q1 and Q2, diodes D1, D2, D3, and D4, capacitors C4 and C5, and resistors R3 and R4. In some embodiments, the transistors Q1 and Q2 are field effect transistors (FET) or junction gate field-effect transistors (JFET). In one embodiment, transistors Q1 and Q2 are n-channel field effect transistors having a gate G, drain D, and source S. In one specific embodiment, transistors Q1 and Q2 are n-channel junction gate field-effect transistors, part no. LSK170 from Linear Integrated Systems. In some embodiments, the capacitors C4 and C5 are 10/16 capacitors and resistors R3 and R4 are 100K resistors. The biasing resistors Rb1 and Rb2, shown in FIG. 5, have each been replaced by two reversed biased diodes D1, D2 and D3, D4, respectively, which act as extremely high-value resistors, as known in the art. Capacitors C4 (126) and C5 (128) are bootstrap capacitors. The current sources 130, 132 include transistors Q3 and Q4 with resistors R1 and R2. In some embodiments, transistors Q3 and Q4 are field effect transistors (FET) or junction gate field-effect transistors (JFET). In one embodiment, transistors Q3 and Q4 are n-channel field effect transistors having a gate G, drain D, and source S. In one specific embodiment, transistors Q3 and Q4 are n-channel junction gate field-effect transistors, part no. LSK170 from Linear Integrated Systems. In some embodiments, R1 and R2 are both 2K2 resistors.

Still referring to the embodiment shown in FIG. 7, resistors R5 and R6 create the bias supply for the two impedance converters. In some embodiments, resistor R5 is a 1M resistor and resistor R6 is 300K resistor. Switch S2, capacitors C6 and C7, and resistors R7 and R8 create a switchable, differential, high-pass filter that can be used to remove unwanted low-frequency energy. In some embodiments, capacitors C6 and C7 are 0U01/FILM capacitors, and resistors R7 and R8 are 1M resistors. The output buffer amplifiers 118, 120 can be emitter follower output buffers. The output buffer amplifiers 118, 120 include transistors Q5 and Q6 with their associated bias resistors R10, R11, R12, and R13. In some embodiments, transistors Q5 and Q6 are bipolar junction transistors or bipolar transistors. In one embodiment, the transistors Q5 and Q6 are PNP type bipolar transistors having a base B, emitter E, and collector C. In some embodiments, resistors R10, R11, R12, and R13 are 330K resistors. Resistors R14 and R15 help determine the microphone output impedance. In some embodiments, resistors R14 and R15 are 47R resistors. Inductors L1 and L2, and capacitors C10, C11, C12, and C13 provide radio-frequency immunity Transistor Q7, diode D5, resistors R16 and R17, and capacitors C14 and C15 create the voltage source VCC (labeled VDD in FIG. 6) to drive the impedance converters 114, 116. In some embodiments, transistor Q7 is a bipolar junction transistor or a bipolar transistor. In one embodiment, transistor Q7 is an NPN type bipolar transistor. In some embodiments, resistor R16 is a 10K resistor, resistor R17 is a 100R resistor, and capacitors C14 and C15 are 10/50 capacitors. According to the embodiment shown, capacitors C1 and C2 are power supply bypassing for the impedance converters 114, 116. Capacitors C8 and C9 provide AC coupling to the impedance converters 114, 116. J4 serves as a connector to ground the case of the microphone and J3 is the signal output connector.

The bootstrap capacitor C4 (126) can feed the output of the impedance converter 114 back into the input of the impedance converter 114, and the bootstrap capacitor C5 (128) can feed the output of the impedance converter 116 back into the input of the impedance converter 116. This slightly less-than-unity positive feedback helps raise the input impedance of the circuit 110 by cancelling out the loading effect of the FET gate capacitance of transistors Q1 and Q2. The two impedance converters 114, 116 are current sourced via current sources 130, 132. The capacitor microphone capsule drives the two FET impedance converters 114, 116, which are driven by the common voltage source VCC. The impedance converters 114, 116 drive the output buffer amplifiers 118, 120. The output of the first impedance converter 114 feeds into the first output buffer amplifier 118, and the output of the second impedance converter 116 feeds into the second output buffer amplifier 120.

Numerous embodiments have been described herein. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

We claim:

1. A microphone circuit comprising:

a capacitor capsule;

first and second impedance converters connected differentially to the capacitor capsule;

a first output buffer amplifier connected to an output of the first impedance converter; and a second output buffer amplifier connected to an output of the second impedance converter;

wherein an output of the first output buffer amplifier and an output of the second output buffer amplifier are connected differentially to one balanced input of an associated mixing console; and wherein the associated mixing console provides phantom power to the impedance converters and the buffer amplifiers out of the balanced input.

2. The microphone circuit of claim 1, wherein the first impedance converter comprises a first field effect transistor including a gate connected to a first terminal of the capacitor capsule, and wherein the second impedance converter comprises a second field effect transistor including a gate connected to a second terminal of the capacitor capsule.

3. The microphone circuit of claim 2, wherein the first output buffer amplifier comprises a first bipolar transistor including a base connected to a source of the first field effect transistor, and wherein the second output buffer amplifier comprises a second bipolar transistor including a base connected to a source of the second field effect transistor.

4. The microphone circuit of claim 1, wherein collectors of the first and second bipolar transistors are connected together.

5. The microphone circuit of claim 4, wherein a voltage applied to drains of the first and second field effect transistors is between 17 and 23 volts.

6. The microphone circuit of claim 5, wherein no electrical isolation is provided between the first impedance converter and the first output buffer amplifier, and wherein no electrical isolation is provided between the second impedance converter and the second output buffer amplifier.

7. The microphone circuit of claim 1, wherein the first impedance converter comprises a first bootstrap capacitor that feeds the output of the first impedance converter back into the input of the first impedance converter, and wherein the second impedance converter comprises a second bootstrap capacitor that feeds the output of the second impedance converter back into the input of the second impedance converter.

8. The microphone circuit of claim 1, wherein the first and second output buffer amplifiers form emitter follower circuits.

9. The microphone circuit of claim 1, wherein the first impedance converter comprises a first current source, and wherein the second impedance converter comprises a second current source.

10. The microphone circuit of claim 9, wherein the first current source comprises a field effect transistor including a gate connected to the signal ground, a source connected to the signal ground through a resistor, and a drain connected to the first impedance converter, and wherein the second current source comprises a field effect transistor including a gate connected to the signal ground, a source connected to the signal ground through a resistor, and a drain connected to the second impedance converter.

11. A microphone circuit comprising:

a capacitor capsule including a first terminal and as second terminal;

first and second impedance converters connected differentially to the capacitor capsule, wherein the first impedance converter comprises a first field effect transistor including a gate connected to the first terminal of the capacitor capsule, wherein the second impedance converter comprises a second field effect transistor including a gate connected to the second terminal of the capacitor capsule, wherein the first impedance converter further comprises a first bootstrap capacitor and a first current source, and wherein the second impedance converter further comprises a second bootstrap capacitor and a second current source;

first and second output buffer amplifiers connected differentially to the impedance converters, wherein the first and second output buffer amplifiers each form an emitter follower circuit, wherein the first output buffer amplifier comprises a first bipolar transistor including a base connected to a source of the first field effect transistor, and wherein the second output buffer amplifier comprises a second bipolar transistor including a base connected to a source of the second field effect transistor;

wherein an emitter of the first bipolar transistor and an emitter of the second bipolar transistor are connected differentially to one balanced input of an associated mixing console; and wherein the associated mixing console provides phantom power to the impedance converters and the buffer amplifiers.

12. The microphone circuit of claim 11, wherein the first bootstrap capacitor feeds the output of the first impedance converter back into the input of the first impedance converter, and wherein the second bootstrap capacitor feeds the output of the second impedance converter back into the input of the second impedance converter.

13. The microphone circuit of claim 11, wherein the first current source comprises a field effect transistor including a gate connected to the signal ground, a source connected to the signal ground through a resistor, and a drain connected to the first impedance converter, and wherein the second current source comprises a field effect transistor including a gate connected to the signal ground, a source connected to the signal ground through a resistor, and a drain connected to the second impedance converter.

14. The microphone circuit of claim 11, wherein collectors of the first and second bipolar transistors are connected together.

15. The microphone circuit of claim 14, wherein a voltage applied to drains of the first and second field effect transistors is between 17 and 23 volts.

16. A method comprising the steps of:

a) connecting first and second impedance converters to a capacitor capsule differentially by connecting the first impedance converter to a first terminal of the capacitor capsule and connecting the second impedance converter to a second terminal of the capacitor capsule;

b) connecting a first output buffer amplifier to an output of the first impedance converter;

c) connecting a second output buffer amplifier to an output of the second impedance converter;

d) connecting an output of the first output buffer amplifier and an output of the second output buffer amplifier differentially to one balanced input of a mixing console; and e) providing phantom power to the impedance converters and the buffer amplifiers from the balanced input of the mixing console.

17. The method of claim 16 further comprising the step of:

connecting a first current source to the first impedance converter;

connecting a second current source the second impedance converter.

18. The method of claim 16 further comprising the steps of:

f) using the phantom power to provide a source voltage between 17 and 23 volts; and g) applying the source voltage to the first and second impedance converters.

* * * * *